US010726971B2

(12) United States Patent
Kojima et al.

(10) Patent No.: US 10,726,971 B2
(45) Date of Patent: Jul. 28, 2020

(54) SHIELDED FLAT CABLE

(71) Applicant: SUMITOMO ELECTRIC INDUSTRIES, LTD., Osaka (JP)

(72) Inventors: Chiaki Kojima, Tochigi (JP); Tatsuo Matsuda, Tochigi (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/416,712

(22) Filed: May 20, 2019

(65) Prior Publication Data

US 2019/0371494 A1 Dec. 5, 2019

(30) Foreign Application Priority Data

May 30, 2018 (JP) ..... 2018-103825

(51) Int. Cl.
*H01B 7/02* (2006.01)
*H01B 7/08* (2006.01)

(52) U.S. Cl.
CPC ..... *H01B 7/0861* (2013.01); *H01B 7/0216* (2013.01); *H01B 7/0838* (2013.01)

(58) Field of Classification Search
CPC ..... H01B 7/02; H01B 7/04; H01B 7/0861; H01B 7/0216; H01B 7/0838
USPC ..... 174/103
See application file for complete search history.

(56) References Cited

U.S. PATENT DOCUMENTS 5,360,944 A * 11/1994 Springer ..... H01B 7/0838 174/102 R
5,455,383 A * 10/1995 Tanaka ..... H01B 7/0861 174/117 A
5,817,769 A * 10/1998 Serrero ..... C07K 14/4705 530/389.2
7,196,273 B2 * 3/2007 Tanaka ..... H01B 7/0861 174/117 F
7,399,929 B2 * 7/2008 Ueno ..... H01B 7/0861 174/117 A
7,569,773 B2 * 8/2009 Hu ..... H05K 1/0221 174/117 FF
7,842,886 B2 * 11/2010 Kobayashi ..... H01P 3/08 174/117 F
7,868,254 B2 * 1/2011 Matsushita ..... H01B 7/0861 174/117 FF
8,138,421 B2 * 3/2012 Takamatsu ..... H01B 3/56 174/117 F (Continued)

FOREIGN PATENT DOCUMENTS

JP 2005-093178 A * 9/2003 ..... H01B 7/08
JP 2011-198687 10/2011

*Primary Examiner* — William H. Mayo, III
(74) *Attorney, Agent, or Firm* — IPUSA, PLLC

(57) ABSTRACT

A shielded flat cable includes conductors arranged parallel to each other and respectively having a first surface and a second surface opposite to the first surface, a first insulator provided on the first surface of each of the conductors, and a second insulator provided on the second surface of each of the conductors. The first surface of each of the conductors includes an exposed surface at an end part along a longitudinal direction. The shielded flat cable further includes a shield member that includes a metal layer and is configured to cover the first insulator and a portion of the exposed surface of the first surface, via a resin layer.

9 Claims, 6 Drawing Sheets

(56) References Cited

U.S. PATENT DOCUMENTS

| | | | | |
|---|---|---|---|---|
| 8,338,709 | B2 * | 12/2012 | Kodama | H01B 7/0838<br>174/110 R |
| 8,723,042 | B2 * | 5/2014 | Yang | H01B 7/0861<br>174/110 R |
| 2004/0011553 | A1 * | 1/2004 | Cianciolo | H01B 7/0838<br>174/117 FF |
| 2011/0100673 | A1 * | 5/2011 | Takamatsu | H01B 7/0861<br>174/102 SP |

* cited by examiner

SHIELDED FLAT CABLE

CROSS-REFERENCE TO RELATED APPLICATIONS

This application is based upon and claims priority to Japanese Patent Application No. 2018-103825 filed on May 30, 2018, the entire contents of which are incorporated herein by reference.

BACKGROUND OF THE INVENTION

1. Field of the Invention

The present invention relates to a shielded flat cable.

2. Description of the Related Art

A Flexible Flat Cable (FFC) is used in various fields for the purposes of providing a simple connection within a limited space. The various fields may use the FFC as an internal wiring or the like of Audio Visual (AV) apparatuses, such as a Compact Disk (CD) player, a Digital Versatile Disk (DVD) player, or the like, Office Automation (OA) apparatuses, such as a copying machine, a printer, or the like, electronic apparatuses, and information appliances, for example. In addition, because the effects of noise increases as the signal frequency used in the apparatus increases, a shielded flat cable, which is shielded, is used to provide the required connection.

As proposed in Japanese Laid-Open Patent Publication No. 2011-198687, for example, the shielded flat cable is shielded by providing a shield member on an outer side of the FFC. In addition, the shielded flat cable includes, on an end part thereof, a terminal part to be connected to a connector. By connecting this terminal part to the connector, which is mounted on a printed circuit board, a printed board, or the like, signal lines of the shielded flat cable are connected to signal lines of the board.

When performing a high-speed transmission, it is not only necessary to provide the shield member to avoid the effects of external noise, but to also match a characteristic impedance of the shielded flat cable to an impedance of the board and the connector. Generally, at the terminal part on the end part along a longitudinal direction of the shielded flat cable, conductors are exposed for making an electrical connection to the connector, and a reinforcing plate is provided to ensure a sufficient strength of the terminal part. For this reason, there is an inconsistency in the characteristic impedance of the shielded flat cable, between the terminal part of the shielded flat cable and other parts of the shielded flat cable.

SUMMARY OF THE INVENTION

One object of the embodiments of the present invention is to provide a shielded flat cable that can obtain a good transmission characteristic by reducing the inconsistency in the characteristic impedance of the shielded flat cable, between the terminal part of the shielded flat cable and other parts of the shielded flat cable.

According to one aspect of the embodiments of the present invention, a shielded flat cable including a plurality of conductors arranged parallel to each other, and respectively having a first surface and a second surface opposite to the first surface; a first insulator provided on the first surface of each of the plurality of conductors; a second insulator provided on the second surface of each of the plurality of conductors, wherein the first surface of each of the plurality of conductors includes an exposed surface at an end part along a longitudinal direction; and a shield member that includes a metal layer and is configured to cover the first insulator and a portion of the exposed surface of the first surface, via a resin layer.

Other objects and further features of the present invention will be apparent from the following detailed description when read in conjunction with the accompanying drawings.

DESCRIPTION OF THE EMBODIMENTS

Figure 1:
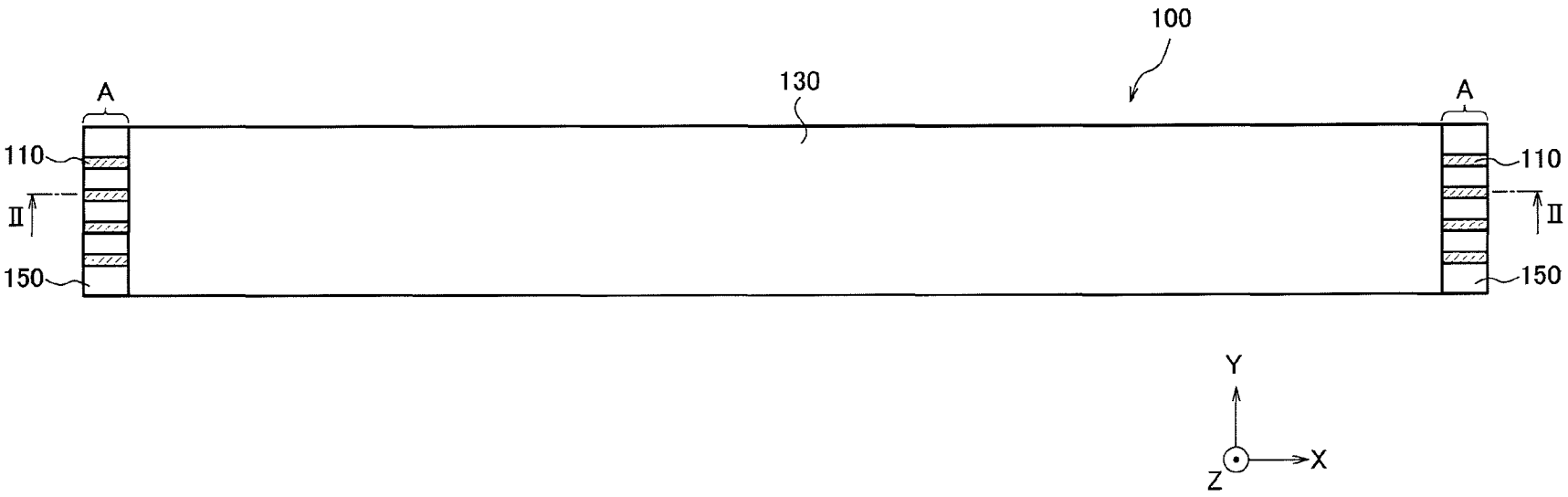
FIG. 1 is a plan view illustrating an example of a shielded flat cable in a first embodiment of the present invention.

According to one embodiment, a shielded flat cable may include a plurality of conductors arranged parallel to each other, and respectively having a first surface and a second surface opposite to the first surface, a first insulator provided on the first surface of each of the plurality of conductors, a second insulator provided on the second surface of each of the plurality of conductors, wherein the first surface of each of the plurality of conductors includes an exposed surface at an end part along a longitudinal direction, and a shield member that includes a metal layer and is configured to cover the first insulator and a portion of the exposed surface of the first surface, via a resin layer. According to this structure, because the shield member is provided up to the exposed surface of each of the plurality of conductors, it is possible to reduce the inconsistency in the characteristic impedance of the shielded flat cable, between a terminal part of the shielded flat cable and other parts of the shielded flat cable, and to obtain the shielded flat cable having a good transmission characteristic.

According to one embodiment, the shield member may further include the resin layer. According to this structure, it is possible to simultaneously adhere the shield member to the first insulator and the portion of the exposed surface of each of the plurality of conductors.

According to one embodiment, the shield member may integrally include a first shield member configured to cover the first insulator, and a second shield member configured to cover the portion of the exposed surface of the first surface. According to this structure, it is possible to reduce the inconsistency in the characteristic impedance of the shielded flat cable, between a terminal part of the shielded flat cable and other parts of the shielded flat cable, and to obtain the shielded flat cable having a good transmission characteristic, using a simple configuration.

According to one embodiment, the shield member may include a first shield member configured to cover the first insulator, and a second shield member, separate from the first shield member, and configured to cover the portion of the exposed surface of the first surface, wherein the second shield member also covers at least a portion of the first shield member. According to this structure, the tolerance during the manufacturing process when providing the shield member on the terminal part can be reduced, because the second shield member that covers the portion of the exposed surface is separate from the first shield member that covers the first insulator.

According to one embodiment, the metal layer of the first shield member is electrically connected to the metal layer of the second shield member. According to this structure, the shielding properties of the shielded flat cable can be improved.

According to one embodiment, the resin layer covering the first insulator, and the resin layer covering the portion of the exposed surface, may have mutually different thicknesses. According to this structure, it is possible to simply adjust the characteristic impedance at the terminal part of the shielded flat cable.

According to one embodiment, the first insulator may be made of a first material, and the second insulator may be made of a second material different from the first material. According to this structure, it is possible to simply adjust the characteristic impedance at the terminal part of the shielded flat cable.

According to one embodiment, the shielded flat cable may further include another shield member that includes another metal layer and is configured to cover the second insulator and another exposed surface of the second surface of each of the plurality of conductors, via another resin layer, at the end part along the longitudinal direction. According to this structure, the shielding is further improved by the provision of the other shield member. In this case, the exposed surface of the first surface of each of the plurality of conductors, at the end part along the longitudinal direction, may form a cable terminal part. In addition, each of the plurality of conductors may be formed by a flat conductor having the first surface and the second surface.

Preferred embodiments of the shielded flat cable according to the present invention will be described with reference to the accompanying drawings. In the drawings, those parts that are the same are designated by the same reference numerals, and a repeated description of the same parts may be omitted.

First Embodiment

Figure 2:
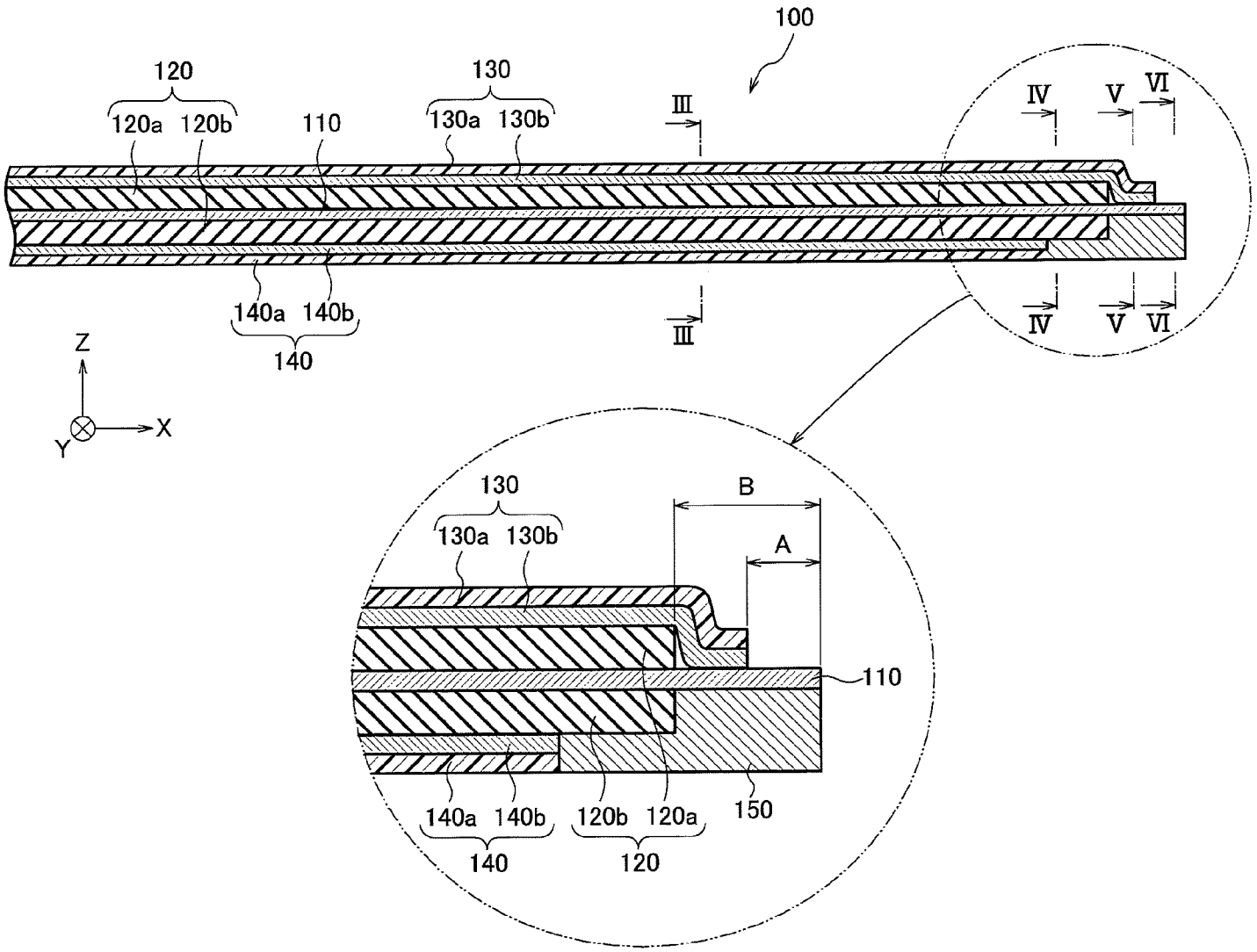
FIG. 2 is a cross sectional view of the shielded flat cable illustrated in FIG. 1, including a planar conductor, along a line II-II in a longitudinal direction.

FIG. 1 is a plan view illustrating an example of the shielded flat cable in a first embodiment of the present invention. FIG. 2 is a cross sectional view of the shielded flat cable illustrated in FIG. 1, including a planar conductor, along a line II-II in a longitudinal direction. A part encircled by a two-dot chain line at an upper right portion of FIG. 2 is indicated on an enlarged scale at a lower portion of FIG. 2. FIG. 3, FIG. 4, FIG. 5, and FIG. 6 are cross sectional views along lines III-III, IV-IV, V-V, and VI-VI in FIG. 2, respectively.

A shielded flat cable 100 in this embodiment includes a plurality of flat conductors 110, an insulating layer 120 that includes a first insulator 120*a* and a second insulator 120*b*, a first shield member 130, a second shield member 140, and a reinforcing plate 150. A center part along a longitudinal direction of the shielded flat cable 100 in this embodiment includes the plurality of flat conductors 110, the first insulator 120*a*, the second insulator 120*b*, the first shield member 130, and the second shield member 140, as illustrated in the cross sectional view of FIG. 3. The second shield member 140 may be omitted, in order to improve the flexibility of the shielded flat cable 100. The shielding is further improved by providing the second shield member 140.

Figure 3:
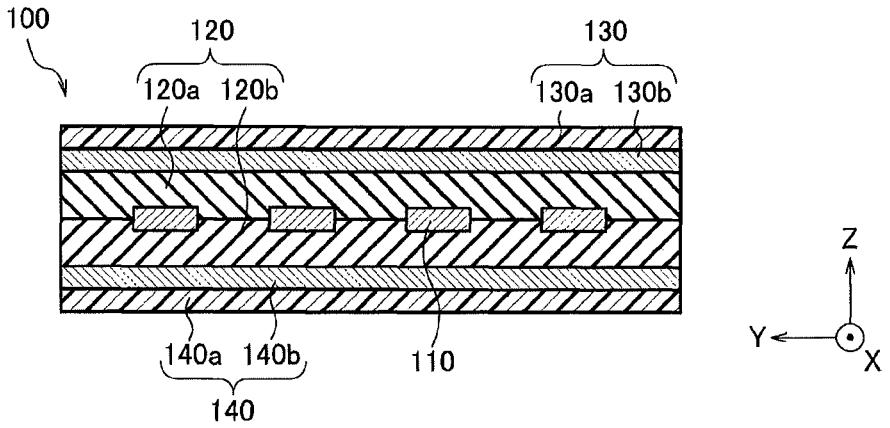
FIG. 3 is a cross sectional view along a line III-III in FIG. 2.

In the shielded flat cable 100, each flat conductor 110 has a flat cross sectional shape and extends along an X-axis direction, and a plurality of such flat conductors 110 are arranged in a Y-axis direction. First and second parallel surfaces of each flat conductor 110, corresponding to upper and lower surfaces of each flat conductor 110 in FIG. 3, are parallel to an XY-plane and are opposite to each other. The first parallel surface (or upper surface) and the second parallel surface (or lower surface) of each flat conductor 110 are respectively covered by and sandwiched between the first insulator 120*a* and the second insulator 120*b*, along a Z-axis direction that is perpendicular to the XY-plane. The first parallel surface (or upper surface) of each flat conductor 110 corresponds to a positive direction side along the Z-axis, and the second parallel surface (or lower surface) of each flat conductor 110 corresponds to a negative direction side along the Z-axis.

At least one end part of the shielded flat cable 100 is not provided with the first insulator 120*a* and the second insulator 120*b*, to form a cable terminal part where the flat conductors 110 are exposed. An exposed surface B of each flat conductor 110, at a part within a range indicated by an arrow B in FIG. 2, may be formed by a first method or a second method. According to the first method, the first and second parallel surfaces of each flat conductor 110 are completely covered by the first insulator 120*a* and the second insulator 120*b*, and the first and second insulators 120*a* and 120*b* covering the parts of each flat conductor 110 within the range indicated by the arrow B are thereafter removed. On the other hand, according to the second method, the first and second insulators 120*a* and 120*b* are respectively formed on the first and second parallel surfaces of each flat conductor 110, excluding the parts within the range indicated by the arrow B. In this embodiment, the first shield member 130 is provided to cover the first insulator 120*a* and a portion of the exposed surface B at the first parallel surface of each flat conductor 110.

Figure 4:
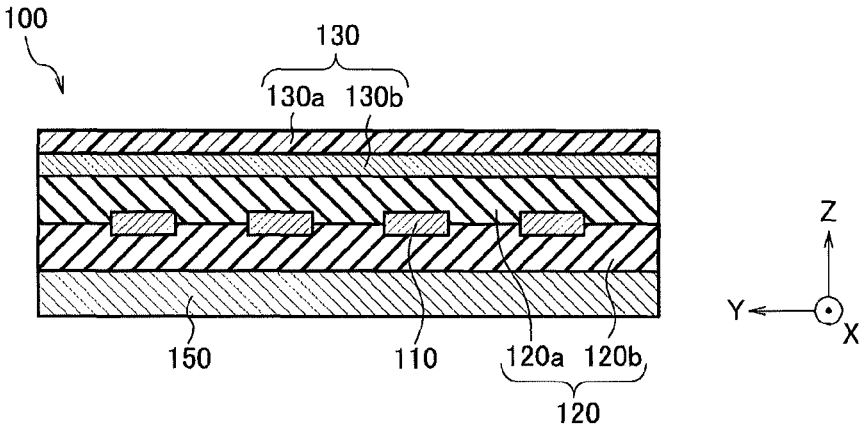
FIG. 4 is a cross sectional view along a line IV-IV in FIG. 2.
Figure 5:
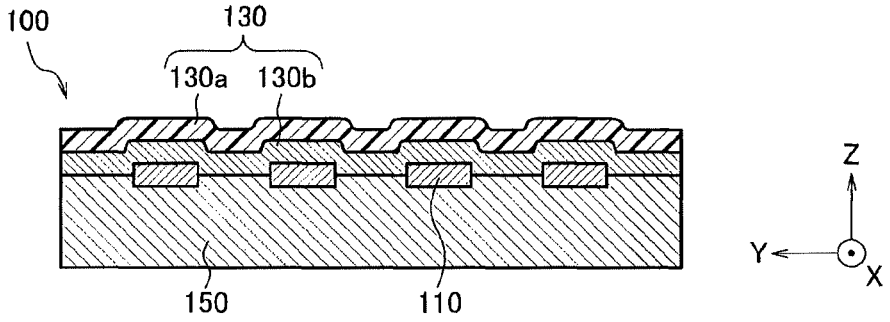
FIG. 5 is a cross sectional view along a line V-V in FIG. 2.
Figure 6:
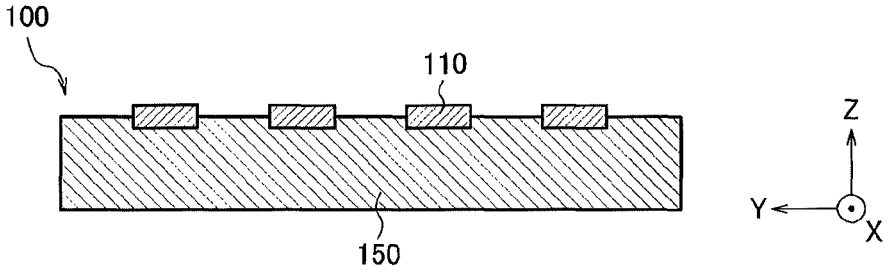
FIG. 6 is a cross sectional view along a line VI-VI in FIG. 2.

As illustrated in the cross sectional view of FIG. 4, at the cable terminal part, the first insulator 120*a* and the first shield member 130 are successively formed to overlap on the first parallel surface of each flat conductor 110, and the second insulator 120*b* and the reinforcing plate 150 are successively formed to overlap on the second parallel surface of each flat conductor 110. In addition, as illustrated in the cross sectional view of FIG. 5, at a part of the cable terminal part near a connection terminal part, the first shield member 130 is arranged on the first parallel surface of each flat conductor 110, and the reinforcing plate 150 is arranged on the second parallel surface of each flat conductor 110. Further, at the connection terminal part indicated by an exposed surface A in FIG. 1, at a part within a range indicated by an arrow A in FIG. 2, the reinforcing plate 150 is arranged only on the second parallel surface of each flat conductor 110, as illustrated in FIG. 6. The exposed surface A at the first parallel surface of each flat conductor 110, where the first shield member 130 is not provided, serves as a cable terminal part when the shielded flat cable 100 is connected to a connector.

Each flat conductor 110 may be made of a metal, such as a copper film, a tinned copper film (or tin-plated annealed copper film), or the like, for example. Each flat conductor 110 may have a thickness of 10 μm to 100 μm along the Z-axis direction, for example, and a width of approximately 0.2 mm to approximately 0.8 mm along the Y-axis direction, for example. The plurality of flat conductors 110 may be arranged parallel to each other at a suitable pitch P of 0.4 mm to 2.0 mm along the Y-axis direction, for example. The arrangement of the plurality of flat conductors 110 is maintained in the state sandwiched between the first insulator 120*a* and the second insulator 120*b*. The plurality of flat conductors 110 are used for signal transmission, however, at least one predetermined flat conductor 110 may be grounded when connected to a connector terminal of the board. For example, the plurality of flat conductors 110 may include signal lines S and ground lines G. In this case, the plurality of flat conductors 110 may include a repetition of two signal lines S and one ground line G along the Y-axis direction, such as a pattern G-S-S-G-S-S-G-S-S-G-S-S-G- . . . . The two adjacent signal lines S in such a repetition may be used for differential transmission.

The first insulator 120*a* and the second insulator 120*b* may be formed by generally available resin films that are sufficiently flexible and include a bonding layer (not illustrated) on an inner surface (or bonding surface) thereof. Examples of suitable resin materials forming the resin films may include polyester resins, polyphenylene sulfide resins, polyimide resins, or the like, for example, having general-purpose properties. The resin films may have a thickness of 9 μm to 100 μm, for example. Suitable polyester resins may include resin materials such as polyethylene terephthalate resins, polyethylene naphthalate resins, polybutylene naphthalate resins, or the like. Among the resins forming the resin films described above, polyethylene terephthalate resins are preferable from a viewpoint of electrical properties, mechanical properties, cost, or the like.

The bonding layer of the resin film, forming the first insulator 120*a* and the second insulator 120*b*, may be made of a resin material. Examples of suitable resin material forming the bonding layer may include adhesive agents made of polyester resins, polyolefin resins, or the like added with a flame retardant, for example. The bonding layer may be formed to a suitable thickness in a range of 10 μm to 150 μm, for example. The first insulator 120*a* and the second insulator 120*b* are arranged with the bonding layers thereof opposing each other via the plurality of flat conductors 110, and the first and second insulators 120*a* and 120*b* are bonded together with the plurality of flat conductors 110 interposed therebetween while applying heat by a heating roller, to laminate and integrate the first and second insulators 120*a* and 120*b* into the insulating layer 120. The first and second insulators 120*a* and 120*b* may be formed by a single layer of resin, such as polyethylene, polypropylene, polyimide, polyethylene terephthalate, polyester, polyphenylene sulfide, or the like, for example, without the use of the bonding layers. In this case, the single layer of resin may have a thickness of approximately 300 μm, for example.

The first shield member 130 and the second shield member 140 may each have a total thickness of approximately 30 μm to approximately 90 μm, for example. The first shield member 130 may have a 3-layer structure including a metal layer 130*a*, a resin layer 130*b*, and a bonding layer (not illustrated), and the second shield member 140 may have a 3-layer structure including a metal layer 140*a*, a resin layer 140*b*, and a bonding layer (not illustrated). Alternatively, the first shield member 130 may have a 2-layer structure including the metal layer 130*a* and the resin layer 130*b*, and the second shield member 140 may have a 2-layer structure including the metal layer 140*a* and the resin layer 140*b*, if the resin layers 130*a* and 130*b* have adhesive properties. The metal layers 130*a* and 140*a* may be formed by aluminum films, for example, but the material forming the metal layers 130*a* and 140*a* is not limited to such. The resin layers 130*b* and 140*b* may be formed by films made of polyethylene terephthalate, of low dielectric constant polyethylene (or low-k polyethylene), for example, but the material forming the resin layers 130*b* and 140*b* is not limited to such. The first shield member 130 is arranged with the metal layer 130*a* facing the outer side and the resin layer 130*b* facing the inner side, to cover the first insulator 120*a* and a portion of the exposed surface at the first parallel surface of each flat conductor 110. In addition, the second shield member 140 is arranged with the metal layer 140*a* facing the outer side and the resin layer 140*b* facing the inner side, to cover the second insulator 120*a*.

The thickness of the resin layer 130*b* of the first shield member 130 and the thickness of the resin layer 140*b* of the second shield member 140 may be adjusted, to adjust a characteristic impedance of the shielded flat cable 100. Further, the resin layer 130*b* of the first shield member 130 electrically insulates the exposed surface at the first parallel surface of each flat conductor 110 from the metal layer 130*a* of the first shield member 130, and serves to prevent a short-circuit between the flat conductors 110. As described above, the second shield member 140 may be omitted in order to improve the flexibility of the shielded flat cable 100.

Although not illustrated in the drawings, a protective layer may be provided to cover the first shield member 130, the second shield member 140, and entire side surfaces of the shielded flat cable 100. The protective layer electrically insulates the shielded flat cable 100 from the outside, and also protects the shielded flat cable 100 from damage caused by external forces. The protective layer may be formed by wrapping a single protective resin film around the peripheral surface of the shielded flat cable 100. It is not essential to provide the protective layer, and the protective layer may be provided according to the usage of the shielded flat cable 100.

The reinforcing plate 150 may be formed by a resin film, and is adhered onto the second parallel surface (or lower surface) of each flat conductor 110 exposed at the cable terminal part. The reinforcing plate 150 provides strength to the shielded flat cable 100, so that the shielded flat cable 100 may be attached to and removed from (that is, detachably connected to) the connector. In this embodiment, the second parallel surface (or lower surface) of each flat conductor 110 is exposed at the end part, and the reinforcing plate 150 is provided on the exposed surface at the second parallel surface of each flat conductor 110. However, the reinforcing plate 150 may be provided on the second insulator 120*b*, without exposing the second parallel surface (or lower surface) of each flat conductor 110. Further, the reinforcing plate 150 may be omitted when the cable terminal part of the shielded flat cable 100 is of adequate strength, and is sufficiently strong for the usage of the shielded flat cable 100, for example.

In this embodiment, at the end part along the longitudinal direction of the shielded flat cable 100, the first parallel surface (or upper surface) of each flat conductor 110 is exposed and not covered by the first insulator 120*a*, to form the cable terminal part where the flat conductors 110 are exposed at the upper surface of the shielded flat cable 100. In addition, the first shield member 130 integrally covers the entire surface of the first insulator 120*a* and the portion of the exposed surface B at the first parallel surface of each flat conductor 110. The exposed surface A at the first parallel surface of each flat conductor 110, not covered by the first shield member 130, contacts a contact member of the connector (not illustrated) when the shielded flat cable 100 is attached to the connector.

[Transmission Characteristic]

Figure 7:
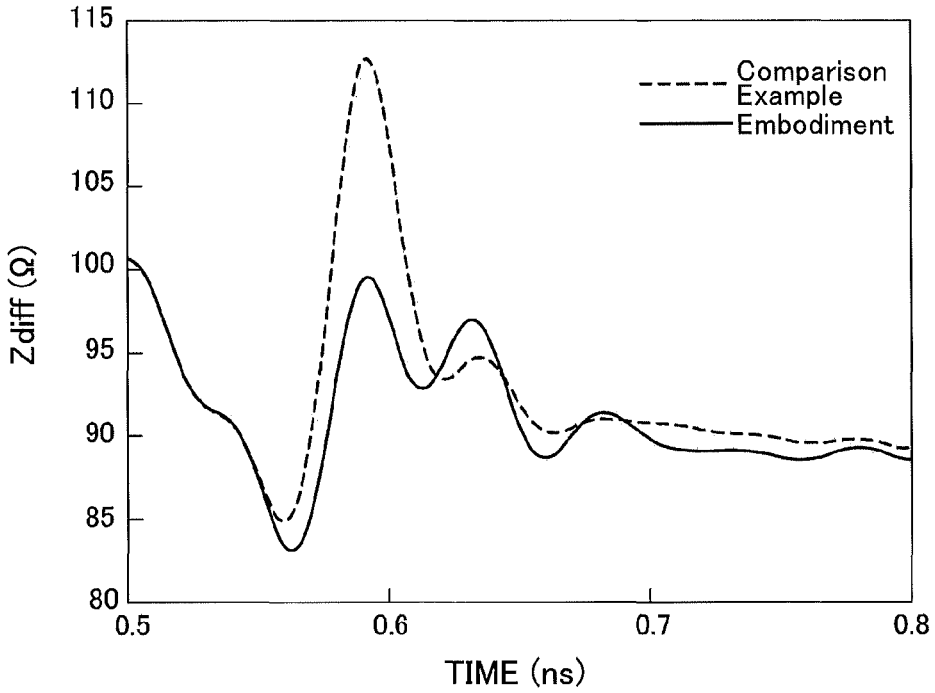
FIG. 7 is a diagram illustrating a differential impedance (Zdiff) of the shielded flat cable for each of a case where a shield member is provided up to an exposed surface of a flat conductor, and a case where no shield member is provided up to the exposed surface of the flat conductor.
Figure 8:
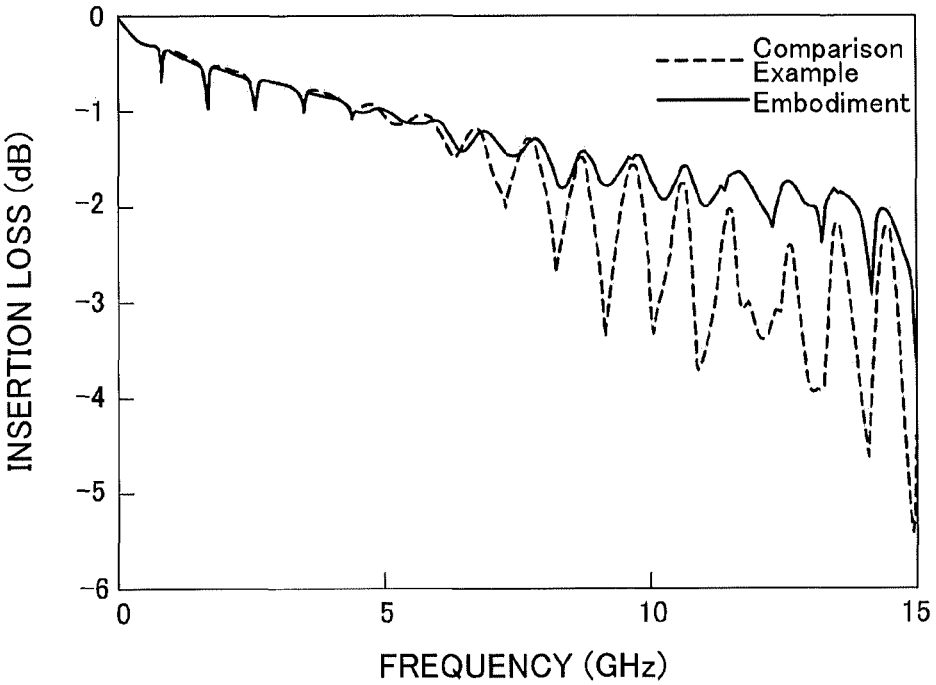
FIG. 8 is a diagram illustrating an insertion loss of the shielded flat cable for each of the case where the shield member is provided up to the exposed surface of the flat conductor, and the case where no shield member is provided up to the exposed surface of the flat conductor.
Figure 9:
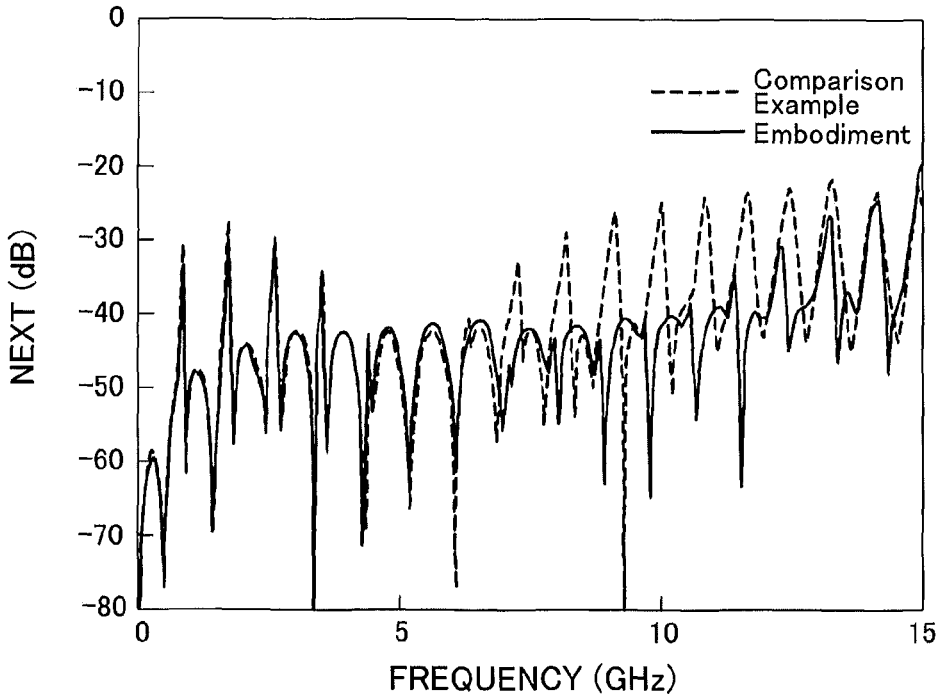
FIG. 9 is a diagram illustrating a Near End Cross Talk (NEXT) of the shielded flat cable for each of the case where the shield member is provided up to the exposed surface of the flat conductor, and the case where no shield member is provided up to the exposed surface of the flat conductor.
Figure 10:
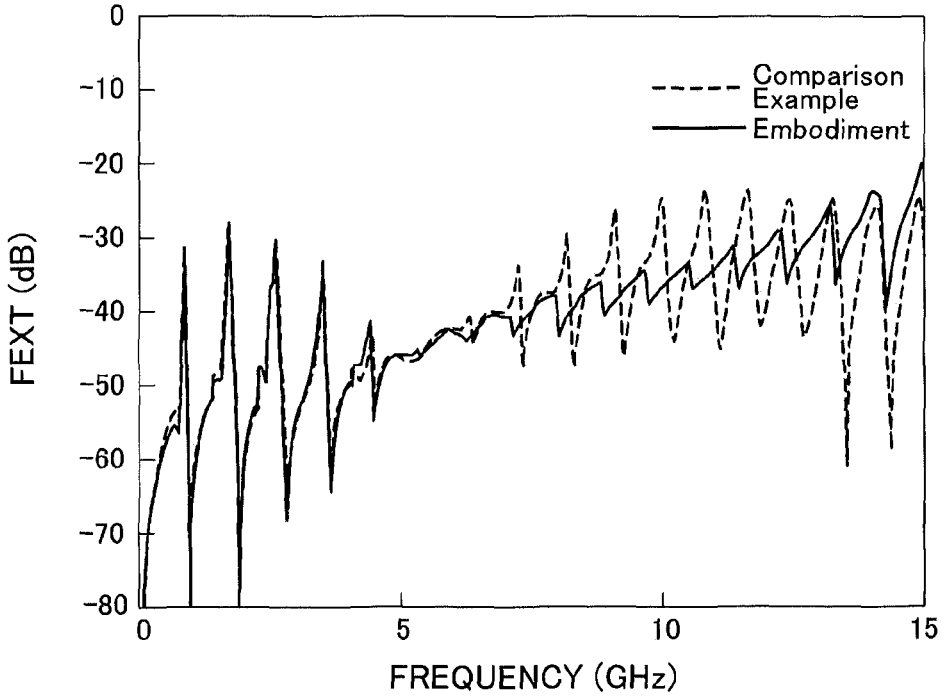
FIG. 10 is a diagram illustrating a Far End Cross Talk (FEXT) of the shielded flat cable for each of the case where the shield member is provided up to the exposed surface of the flat conductor, and the case where no shield member is provided up to the exposed surface of the flat conductor.

Next, a transmission characteristic of the shielded flat cable in one embodiment will be described. FIG. 7 is a diagram illustrating a differential impedance (Zdiff) of the shielded flat cable for each of a case where the shield member is provided up to the exposed surface of the flat conductor, and a case where no shield member is provided up to the exposed surface of the flat conductor. FIG. 8 is a diagram illustrating an insertion loss of the shielded flat cable for each of the case where the shield member is provided up to the exposed surface of the flat conductor, and the case where no shield member is provided up to the exposed surface of the flat conductor. FIG. 9 is a diagram illustrating a Near End Cross Talk (NEXT) of the shielded flat cable for each of the case where the shield member is provided up to the exposed surface of the flat conductor, and the case where no shield member is provided up to the exposed surface of the flat conductor. FIG. 10 is a diagram illustrating a Far End Cross Talk (FEXT) of the shielded flat cable for each of the case where the shield member is provided up to the exposed surface of the flat conductor, and the case where no shield member is provided up to the exposed surface of the flat conductor. In each of FIG. 7 through FIG. 10, the case where the shield member is provided up to the exposed surface of the flat conductor corresponds to one embodiment indicated by the dotted line, and the case where no shield member is provided up to the exposed surface of the flat conductor corresponds to a comparison example.

In the differential impedance illustrated in FIG. 7, a region where the time is longer than approximately 0.6 ns corresponds to the differential impedance of the shielded flat cable 100, and a region where the time is shorter than or equal to approximately 0.6 ns corresponds to the differential impedance of the board including the connector. Compared to the comparison example in which no shield member is provided up to the exposed surface of the flat conductor, the differential impedance of the embodiment in which the shield member is provided up to the exposed surface of the flat conductor is greatly reduced in the region where the time is slightly shorter than 0.6 ns. This region where the differential impedance is greatly reduced, corresponds to the cable terminal part of the shielded flat cable 100. Accordingly, the embodiment can greatly improve the mismatch of the differential impedances. As a result, the embodiment can also improve the characteristic impedance of shielded flat cable 100.

As for the insertion loss illustrated in FIG. 8, a frequency-dependent variation of the embodiment, in which the shield member is provided up to the exposed surface of the flat conductor, is greatly improved in a high-frequency band of 7 GHz or higher, when compared to the comparison example, in which no shield member is provided up to the exposed surface of the flat conductor. Moreover, as for the Near End Cross Talk (NEXT) illustrated in FIG. 9, the NEXT of the embodiment, in which the shield member is provided up to the exposed surface of the flat conductor, is greatly reduced in a frequency band of 7 GHz to 14 GHz, when compared to the comparison example, in which no shield member is provided up to the exposed surface of the flat conductor. Further, as for the Far End Cross Talk (FEXT) illustrated in FIG. 10, the FEXT of the embodiment, in which the shield member is provided up to the exposed surface of the flat conductor, is greatly reduced in a frequency band of 7 GHz to 13 GHz, when compared to the comparison example, in which no shield member is provided up to the exposed surface of the flat conductor. In addition, the variation of the FEXT of the embodiment is reduced when compared to the comparison example.

Hence, according to the embodiment, a considerable improvement can be observed in each of the characteristics including the differential impedance, the insertion loss, the NEXT, and the FEXT, when compared to the comparison example in which no shield member is provided up to the exposed surface of the flat conductor.

Second Embodiment

Figure 11:
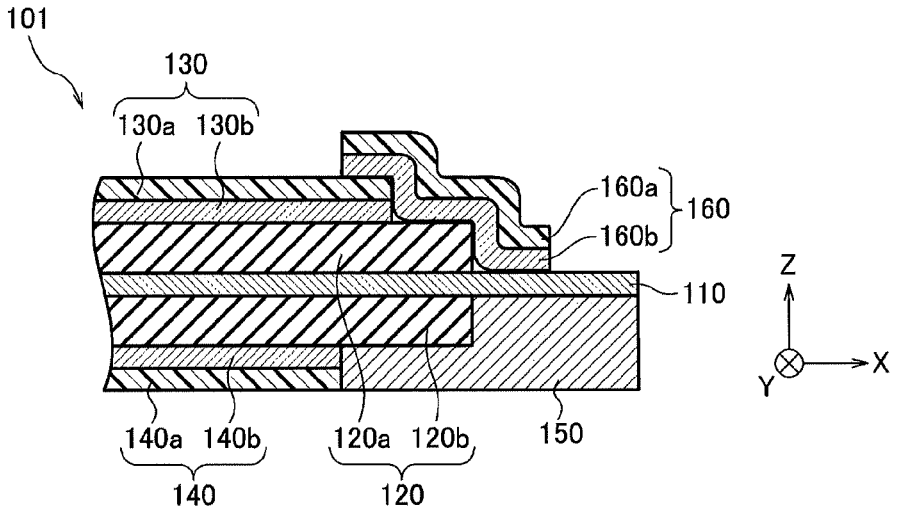
FIG. 11 is a cross sectional view along the longitudinal direction of the shielded flat cable in a second embodiment of the present invention.

FIG. 11 is a cross sectional view along the longitudinal direction of the shielded flat cable in a second embodiment of the present invention. The shielded flat cable 100 in the first embodiment uses the first shield member 130 covering the first insulator 120*a*, and the first shield member 130 covering the portion of the exposed surface B at the first parallel surface of each flat conductor 110, which integrally form a single shield member. In contrast, a shielded flat cable 101 in the second embodiment uses an end part shield member 160, which is separate from the first shield member 130 covering the first insulator 120*a*, to cover the portion of the exposed surface B at the first parallel surface of each flat conductor 110.

As illustrated in FIG. 11, the end part shield member 160 includes a metal layer 160*a* and a resin layer 160*b*, similar to the case of the first shield member 130. The end part shield member 160 additionally includes a bonding layer on the side of the resin layer 160*b*, when the resin layer 160*b* has no adhesive properties. The end part shield member 160 is arranged to cover a portion of the exposed surface B at the first parallel surface of each flat conductor 110, and also cover the end part of the first shield member 130. The metal layer 160*a* and the resin layer 160*b* of the end part shield member 160 may have configurations that are respectively similar to those of the metal layer 130*a* and the resin layer 130*b* of the first shield member 130, or may have configurations that are respectively different from those of the metal layer 130*a* and the resin layer 130*b* of the first shield member 130.

In the second embodiment, the characteristic impedance of the cable terminal part of the shielded flat cable 101 may be adjusted by selecting the thickness and the material used for the resin layer 160*b*. In the first embodiment, when the shielded flat cable 100 is long, a tolerance of each member along the longitudinal direction becomes large during the process of manufacturing the shielded flat cable 100, to thereby make it difficult to adhere the first shield member 130 to a desired position on the exposed surface B at the first parallel surface of each flat conductor 110. For this reason, the characteristic impedance may become inconsistent among the individual shielded flat conductors 100. On the other hand, in the second embodiment, the length of the end part shield member 160 may be reduced regardless of the length of the first shield member 130, and the first shield member 130 may be adhered to a desired position on the exposed surface B at the first parallel surface of each flat conductor 110, thereby making it possible to manufacture shielded flat cables 101 having a consistent (or approximately the same) characteristic impedance.

Third Embodiment

Figure 12:
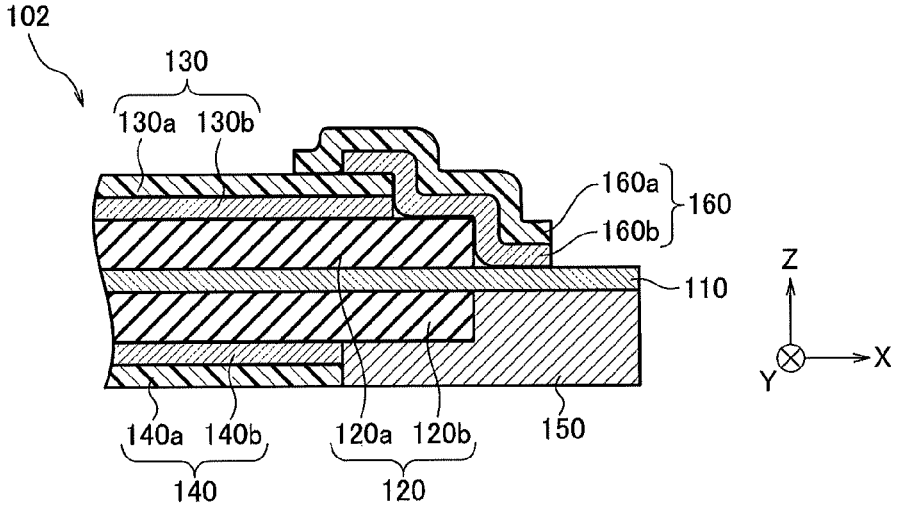
FIG. 12 is a cross sectional view along the longitudinal direction of the shielded flat cable in a third embodiment of the present invention.

FIG. 12 is a cross sectional view along the longitudinal direction of the shielded flat cable in a third embodiment of the present invention. A shielded flat cable 102 in the third embodiment uses the first shield member 130 covering the first insulator 120*a*, and the end part shield member 160, which is separate from the first shield member 130, to cover the portion of the exposed surface B at the first parallel surface of each flat conductor 110, similar to the second embodiment. The metal layer 160*a* of the end part shield member 160 electrically connects to the metal layer 130*a* of the first shield member 130. According to this configuration, the shielded flat cable 102 can obtain effects similar to those obtainable by the shielded flat cable 101 in the second embodiment, and also improve the shielding property of the shielded flat cable 102. Otherwise, the configuration of the shielded flat cable 102 in the third embodiment is similar to that of the shielded flat cable 101 in the second embodiment, and thus, a description of the similar configuration will be omitted.

The embodiments described above may be arbitrarily combined, if required. For example, the configuration of the cable terminal part in the first embodiment, which covers the exposed surface of each flat conductor 110 at the first parallel surface by the first shield member 130, may be employed at one end of cable terminal part of the shielded flat cable, and the configuration of the cable terminal part in the second or third embodiment, which covers the exposed surface of each flat conductor 110 at the first parallel surface by the end part shield member 160, may be employed at the other end of cable terminal part of the shielded flat cable. In this case, even when the first shield member 130 becomes long, it is possible to adhere the first shield member 130 to the desired position on the exposed surface at the first parallel surface of each flat conductor 110, at the cable terminal part on one end of the shielded flat cable, and to adhere the end part shield member 160 to the desired position on the exposed surface at the first parallel surface of each flat conductor 110, at the cable terminal part on the other end of the shielded flat cable. For this reason, inconsistencies in the characteristic impedances among the individual shielded flat conductors, caused by the tolerance of each member along the longitudinal direction during the process of manufacturing the shielded flat cable, can be reduced or eliminated.

Although the first shield member 130, the second shield member 140, and the end part shield member 160 respectively include the metal layer and the resin layer in the embodiments described above, each of the first shield member 130, the second shield member 140, and the end part shield member 160 may include only the metal layer. In this case, the metal layer may cover the first insulator 120*a* and the portion of the exposed surface of the flat conductor 110 via a separate resin layer. When the shield member includes the metal layer and the resin layer, the metal layer and the resin layer may be simultaneously adhered to the first insulator 120*a* and the portion of the exposed surface of the flat conductor 110. In contrast, when the shield member includes only the metal layer, the metal layer and the separate resin layer may be individually adhered to the first insulator 120*a* and the portion of the exposed surface of the flat conductor 110.

Hence, according to each of the embodiments described above, it is possible to provide a shielded flat cable that can obtain a good transmission characteristic by reducing the inconsistency in the characteristic impedance of the shielded flat cable, between the terminal part of the shielded flat cable and other parts of the shielded flat cable.

Although the embodiments are numbered with, for example, "first," "second," or "third," the ordinal numbers do not imply priorities of the embodiments.

Further, the present invention is not limited to these embodiments, but various variations, modifications, and substitutions may be made without departing from the scope of the present invention.

What is claimed is:

1. A shielded flat cable comprising:

a plurality of conductors arranged parallel to each other, and respectively having a first surface and. a second surface opposite to the first surface;

a first insulator provided on the first surface of each of the plurality of conductors;

a second insulator provided on the second surface of each of the plurality of conductors, wherein the first surface of each of the plurality of conductors includes an exposed surface at an end part along a longitudinal direction; and a shield member that includes a metal layer and is configured to cover the first insulator and a portion of the exposed surface of the first surface, via a resin layer, wherein the shield member covers an upper surface of the first insulator, opposite to the first surface, and a side surface of the first insulator, exposed at the end part, and wherein the exposed surface of each of the plurality of conductors, at the end part, is arranged along a predetermined direction perpendicular to the longitudinal direction. and is located on an outer side of the side surface of the first insulator layer towards a tip of each of the plurality of conductors along the longitudinal direction, to farm a cable terminal part.

2. The shielded fiat cable as claimed in claim 1, wherein the shield member further includes the resin layer.

3. The. shielded flat cable'as claimed in claim 1, wherein the shield member integrally includes a first shield member configured to cover the first insulator, and a second shield member configured to cover the portion of the exposed surface of the first surface.

4. The shielded flat cable as claimed in claim 1, wherein the shield member includes a first shield member configured to cover the upper surface of the first insulator, and a second shield member, separate from the first shield member, and configured to cover the portion of the exposed surface of the first surface, wherein the second shield member covers a portion of the first shield member, a portion of the upper surface of the first insulator, and the side surface of the first insulator, exposed at the end part.

5. The shielded flat cable as claimed in claim 4, wherein the metal layer of the first shield member is electrically connected to the metal layer of the second shield member.

6. The shielded flat cable as claimed in claim 1, wherein the resin layer covering the first insulator, and the resin layer covering the portion of the exposed surface, have mutually different thicknesses.

7. The shielded fiat cable as claimed in claim 1, wherein the first insulator is made of a first material, and the second insulator is made of a second material different from the first material.

8. The shielded fiat cable as claimed in claim 1, further comprising another shield member that includes another metal layer and is configured to cover the second insulator and another exposed surface of the second, surface of each of the plurality of conductors, via another resin layer, at the end part along the longitudinal direction.

9. The shielded flat cable as claimed in claim 8, wherein each of the plurality of conductors is formed h a fiat conductor having the first surface and the second surface.

* * * * *